US010745088B2

(12) United States Patent
Llago Hermida

(10) Patent No.: US 10,745,088 B2
(45) Date of Patent: Aug. 18, 2020

(54) SYSTEM AND METHOD FOR CONSTRUCTING HABITABLE INSTALLATIONS FOR FLOATING STRUCTURES

(71) Applicant: GABADI S.L, Naron (ES)

(72) Inventor: Antonio José Llago Hermida, Naron (ES)

(73) Assignee: GABADI S.L., Naron (ES)

( * ) Notice: Subject to any disclaimer, the term of this patent is extended or adjusted under 35 U.S.C. 154(b) by 0 days.

(21) Appl. No.: 16/099,239

(22) PCT Filed: Apr. 25, 2017

(86) PCT No.: PCT/ES2017/070252
§ 371 (c)(1),
(2) Date: Nov. 6, 2018

(87) PCT Pub. No.: WO2017/194799
PCT Pub. Date: Nov. 16, 2017

(65) Prior Publication Data

US 2019/0144081 A1 May 16, 2019

(30) Foreign Application Priority Data

May 11, 2016 (ES) ..... 201630605

(51) Int. Cl.
*B63B 29/02* (2006.01)
*B63B 35/44* (2006.01)
(Continued)

(52) U.S. Cl.
CPC ..... *B63B 29/025* (2013.01); *B63B 25/00* (2013.01); *B63B 35/44* (2013.01); *B63B 73/00* (2020.01);
(Continued)

(58) Field of Classification Search
CPC ..... B63B 25/00; B63B 25/28; B63B 29/00; B63B 29/02; B63B 29/025; B63B 9/00;
(Continued)

(56) References Cited

U.S. PATENT DOCUMENTS 4,779,552 A * 10/1988 Harsia ..... B63B 29/025 114/71
4,890,565 A * 1/1990 Kelly ..... B63B 25/28 114/72
(Continued)

*Primary Examiner* — Lars A Olson

(57) ABSTRACT

The invention relates to a method for constructing habitable installations for floating structures, comprising the following steps: lowering a first adapted standard container (3) through at least one vertical prismatic cavity (25) of a carrying structure (2) until it is supported on support brackets (4) of the floor below; securing the first container (3) to said support brackets (4) of the floor below; and, for each subsequent floor, securing a number of subsequent support brackets (4) to the carrying structure (2) on each container (3) already in position; lowering a subsequent container (3) until it is supported on said subsequent support brackets (4); and securing said subsequent container (3) to subsequent support brackets (4) on which it is resting. The invention also includes a habitable installation (1) constructed according to said method, and a container (3) adapted for carrying out said method.

12 Claims, 5 Drawing Sheets

(51) Int. Cl.

| | |
|---|---|
| ***E04H 1/12*** | (2006.01) |
| ***E04B 1/24*** | (2006.01) |
| ***E04B 1/34*** | (2006.01) |
| ***B63B 25/00*** | (2006.01) |
| ***E04B 1/348*** | (2006.01) |
| ***B63B 73/00*** | (2020.01) |

(52) U.S. Cl.
CPC ..... *E04B 1/24* (2013.01); *E04B 1/348* (2013.01); *E04H 1/12* (2013.01); *B63B 2035/4426* (2013.01)

(58) Field of Classification Search
CPC ..... B63B 9/06; B63B 35/00; B63B 35/44; B63B 3/00; B63B 3/08; E04B 1/24; E04B 1/343; E04B 1/348; E04B 2/721; E04B 5/48; E04H 1/005; E04H 1/04; E04H 1/12
USPC ..... 114/71, 72, 65 R
See application file for complete search history.

(56) References Cited

U.S. PATENT DOCUMENTS 4,959,933 A * 10/1990 Lappi ..... B63B 29/025 114/77 R
5,335,614 A * 8/1994 Klaus ..... B63B 29/025 114/71
6,016,636 A * 1/2000 Caputo ..... B63B 29/025 114/71
6,260,496 B1 * 7/2001 Chevalier ..... B63B 29/025 114/71

* cited by examiner

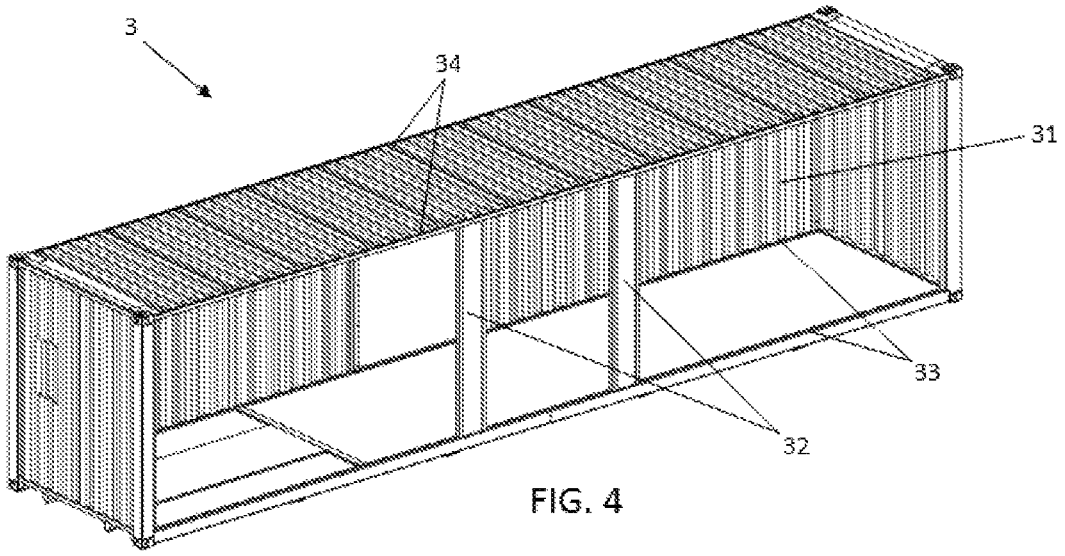
FIG. 4
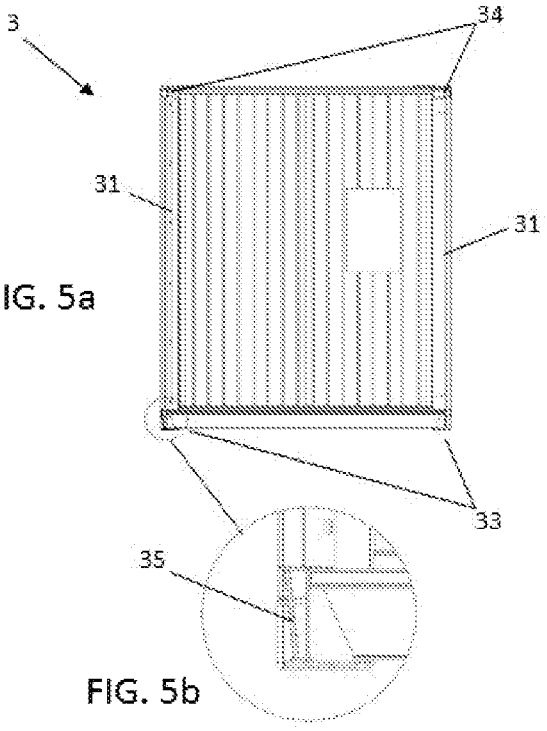
FIG. 5a
FIG. 5b

SYSTEM AND METHOD FOR CONSTRUCTING HABITABLE INSTALLATIONS FOR FLOATING STRUCTURES

System and procedure for the construction of living quarters for floating artefacts.

SUBJECT OF THE INVENTION

This invention belongs, in general terms, to the field of living quarters construction for floating artefacts, to be used by crew or passage in any floating artefact, such as vessels or oil platforms.

A first subject of this invention is a construction procedure for living quarters for floating artefacts, improved by using standardized containers.

A second subject of this invention is a living quarter for floating artefacts, manufactured by using standardized containers, in compliance with the aforementioned procedure.

A third subject of this invention is a standardized container, adapted to the construction of a living quarter, in compliance with the aforementioned procedure.

BACKGROUND OF THE INVENTION

The living quarters construction for floating artefacts involves some specific difficulties, which do not apply to onshore construction. In particular, it is necessary to consider that those artefacts are in continuous movement, due to the waves. Therefore, the construction of any type of facilities on the deck of a vessel or on a platform must be executed, while paying special attention to safety terms and conditions, and as fast as possible. A fast construction also has advantages from other perspectives, because it minimizes construction costs and there are less risks involved for the operators.

Nowadays, several construction procedures for floating artefacts are well-known, based on the use of unitary modules which are built and conditioned onshore, and they are afterwards transported to the floating artefact for its erection on a structure made of beams and columns with certain holes, aimed for the insertion of the modules. This implies significant time and costs saving, because the onshore modules conditioning may be executed under controlled conditions at the manufacturer's factory. Apart from that, the number of tasks to be performed offshore, which are far more dangerous and complicated than those onshore, is minimized.

Document US2005/0155538 named "System and method in water-craft or other structure" describes a construction procedure for floating artefacts, based on unitary modules of the aforementioned type. As it has already been indicated, firstly, one structure made of beams and columns, provided with parallelepiped horizontal holes for the insertion of the unitary modules, is built. Afterwards, the modules are transported to the floating artefact and they are placed at the structure location. The insertion of the modules is performed sideways, and, after, those modules are fixated to the structure. Usually, it is done by using fixation components, such as screws or bolts, or by applying welding. This document displays the uniqueness of the modules being provided with certain specific holes, aimed for fitting them at the location and in the position in which certain beams of the structure are.

Document EP1454824, named "A method and cabin check arrangement in a large passenger vessel" describes one construction system, which is similar to the aforementioned one, in which the structure is built first and then the unitary modules are placed at their location. In this document, the sideways insertion of those unitary modules in the structure is also reported, together with their ulterior fixation, performed by welding, bolting or similar methods.

Document U.S. Pat. No. 2,499,498, named "Mobile housing unit" describes a construction procedure of a housing block, based on mobile units. Even though it is a procedure conceived for onshore construction, many of its characteristics are similar to those of the previously described procedures.

DESCRIPTION OF THE INVENTION

This invention describes a construction procedure of living quarters for floating artefacts which imply several advantages, when compared to the systems and procedures which are known up to date.

In this document, the term "living quarter" refers to any type of construction for a floating artefact, which involves certain rooms aimed for being used by people, no matter if they are for being used as cabins, living rooms, meeting rooms, dining rooms, etc.

In this document, the term "floating artefact" refers to any artefact aimed for floating and for being used on the water surface, no matter if it is for sea, rivers, lakes, marshes, etc., including vessels, offshore fixed or mobile platforms, of other forms of floating artefacts.

In this document, the term "point support" refers to a support which only occupies a very short section of one standardized container's edge, when compared to the total length of that edge. As it will be further described herein, a standardized container is conceived in order for it to be supported by four point supports only, located at its corners. These point supports differ from the supports used in the aforementioned technique, which often occupy two full edges of the used modules, or even its four full edges.

In this document, the term "standardized container" refers to a standard container which complies with ISO 668 regulations, by virtue of which the conditions to be complied with by a container for maritime transport are established. One standardized container is parallelepiped shaped, with standardized dimensions which allow for it to be transported by overland transport (trucks or trains), as well as by maritime transport in vessels. Apart from that, a standardized container's structural resistance allows for it to be piled at several levels. One standardized container also has some rectangular holes, or reinforced edge protectors located at its corners for allowing temporary fixation among them, or to the surface over which some standardized devices named "twist-lock" are supported.

In this document, "twist-lock device" refers to the aforementioned standardized fixation devices, which enables the temporary fixation of the standardized containers among them, or to other components, such as a vessel's deck, or the lower surface of the platform of a train or truck wagon. One fixation system, based on twist-lock devices, is made of the twist-lock device itself and by a reinforced edge protector. The reinforced edge protector is mainly composed of one hole which is essentially rectangular made on a flat plate. A twist-lock device mainly consists of a rectangular protruding projection, setup for going through the reinforced edge protector and which can rotate in 90°, in relation to the junction of the reinforced edge protector. As a result, once the twist-lock device is fitted in the reinforced edge protector, and that it has been rotated, both components are fully and solidly assembled. In order to disassemble them, it is enough to rotate twist-lock device in 90° again, until it is oriented once again towards the position of the aforementioned reinforced edge protector. One standardized container is provided, both at its four lower and four upper corners with reinforced edge protectors. This allows, for example, to fixate the standardized container to the vessel's deck during transport, owing to the twist-lock devices which are coupled with the reinforced edge protectors at the lower corners of the container. It is also possible to fixate one standardized container, especially, if using double twist-lock devices, which are basically components with two rectangular opposite protruding projections, able to rotate 90°, in relation to an initial position. That provided, one of the protruding projections of the double twist-lock device is coupled with the reinforced edge protector at the upper corner of a first container, and the second protruding projection of the double twist-lock device is coupled with the reinforced edge protector at the lower corner of a second container, which is supported by the first container.

One characteristic of this invention consists of a construction procedure for living quarters for floating artefacts which involves the following steps:

1) Build a supporting structure on the floating artefact, aimed for supporting several levels of standardized containers:

This supporting structure is usually made of a base frame, composed of longitudinal and cross beams, which are joint by welding to the floating artefact and of one structure, which is made of vertical columns and horizontal beams, displayed over the aforementioned base frame. In this invention, vertical columns and horizontal beams of the structure are arranged in such a manner that the supporting structure has certain rectangular vertical prismatic holes, aimed for the insertion of standardized containers, as it will be described in further detail herein. The vertical beams are fixated to a stool, which is simultaneously fixated to the deck of the floating artefact, in order for the loads that it supports to be distributed, and the deck will have to be duly reinforced under the deck.

2) Fixate some adapted standardized containers, to the supporting structure, so that they result in a multilevel-living quarters facilities installation.

Once the aforementioned supporting structure has been completed, the placement and fixation of the adapted standardized containers, which are adapted, is executed by using one crane, which may be fixated to the floating artefact itself or it may be within an auxiliary vessel. The standardized containers shall have previously undergone an adaption procedure onshore, in order for it to be possible to use them as the type of room, with the corresponding functions, for which they are designed for in each case in particular. This adaptation procedure, about which the main characteristics will be explained in further detail herein, may include, among others, the suppression of some walls, in order to create bigger rooms, when compared to a single standardized container size; the elimination of part of the ceiling or flooring, in order for making room for the stairs between containers; doors and windows installation; the arrangement and setup of piping and electricity wiring; fixed furniture installation, etc. In short, the adapted standardized containers are ready to be used by the corresponding personnel or passage, once they are fixated to the structure and properly interconnected. Apart from that, all these modifications are made in such a manner that the containers dimensions and structural resistance are not altered, so they can be transported and handled in the same manner as standardized containers always are.

The fixation process for the adapted standardized containers to the supporting structure mainly involves the following steps:

2a) Unload a first adapted standardized container, through a vertical prismatic hole within the supporting structure, until it leans on some supports at the lowest level.

2b) Fixate the first adapted standardized container to those support at the lowest level.

2c) For each ulterior level, it shall be necessary to fixate the subsequent supports to the supporting structure, over each adapted standardized container. Then, unload the subsequent adapted standardized container, until when it reaches the point of leaning on the aforementioned supports, and, afterwards, fixate that adapted standardized container to the subsequent supports on which it leans, and so on for the remaining containers.

This procedure differs from those which were known up to date in the technique to be used, as until now the placement of the modules within the structure was performed by sideways insertion. In fact, as modules need to be transported by using one crane, their insertion until their appropriate location, if done sideways, poses several problems, because the crane wire does not allow a full insertion of each module until its final location. Therefore, in those cases it is necessary to use auxiliary resources which make it possible for it to lean the module in such a manner that it slides over the structure, so that a partial support is achieved first, and, afterwards, once the module has been detached from the crane, it is fully inserted and supported. One procedure of this type is described, for example, in the aforementioned document U.S. Pat. No. 2,499,498, in which rails are used for allowing the initial support of the modules, in order for them to be pushed afterwards, until their full insertion into the structure is reached. Moreover, this operation would be specially complicated, if executed offshore, due to the movements caused by the waves.

This invention's procedure solves these problems, because the supporting structure is provided with, at least, one vertical prismatic hole, through which standardized containers are vertically inserted. This vertical prismatic hole has a cross section with a shape which matches that of a standardized container, usually rectangular. Once each standardized container is placed by using a crane from over the vertical hole, it suffices with making it move vertically downwards through the vertical hole, until the lowest placement possible is reached. The standardized containers are progressively placed, by starting with the standardized container to be at the lowest level. Once the standardized container of the lowest level has been unloaded until reaching its position, the supports for the following level container are connected to the supporting structure and the following level container is unloaded until it reaches those supports. This process is repeated for subsequent modules, until the standardized container to at the highest level is placed.

Another advantage of this assembly procedure is related to the use of standardized containers. As it has been previously indicated, standardized containers have standard dimensions, which enable their transport by truck or by train. This makes for their transport from the manufacturer's factory, where containers are adapted to the different uses within the living quarters, until the port for maritime transport or until the floating artefact, to be easier.

Standardized containers also offer the great advantage of being structurally designed in such a manner that it is possible for them to be supported by four point supports only, placed at the corners. Therefore, in an especially preferred embodiment of this invention's procedure, each standardized container is supported by, at least, four point supports, which are fixated to the columns of the supporting structure, near the intersections between beams and columns, so that the location where supports are placed substantially matches the corners of the adapted standardized containers. This differs from the modules which were used by the systems known until now, which, in most cases, needs for the whole lower face of the module, or four fully reinforced edge supports in the lower edges, to be supported. Within this invention, the use of point supports makes its connections operation among containers easier, as modules are installed, by making it only necessary for four point supports for each container to be used. This saves time and material, during the containers' fixation process. Therefore, it is expected for it to be possible to fixate the point supports to the supporting structure by applying any technique manner, such as welding or bolting, provided that they duly comply with their functions, in terms of supporting the standardized containers which are supported by them.

Standardized containers also involve the advantage of being provided with reinforced edge protector in their corners, for their fixation with twist-lock devices. Therefore, in other specially preferred embodiment of this invention's procedure, the fixation of each unitary module to the point supports is executed by using twist-lock devices. For that purpose, the point supports themselves may be equipped with twist-lock devices, setup for being inserted into the reinforced edge protectors at the corners of the adapted standardized containers. In another preferred embodiment, the point supports may include reinforced edge protectors. In that case, for each containers' corner, the fixation with twist-lock devices is executed by inserting a double twist-lock in a reinforced edge protector of the point support and in one reinforced edge protector at a corner of the adapted standardized container. It must be noted that, until now, fixation systems with twist-lock devices had always been used for temporary fixation of the containers during transport. However, the inventors of this applications have discovered that, within the context of construction of living quarter for floating artefact, the fixation provided by twist-lock devices suffices for final fixation of the standardized containers to the support system. In this manner, both time and materials are saved, when compared to other construction methods used until now, in which modules were fixated to the structure by applying welding, screws or similar methods. Apart from that, the use of twist-lock devices for the containers' fixation to the point supports allows for the dismantlement of the living to be very easy.

In compliance with other preferred embodiment of the invention, the subsequent supports are fixated, approximately, at one meter over the ceiling of the adapted standardized container, right below them. Within this context, the expression "approximately one meter" refers to a height which suffices for allowing the space between each adapted standardized container and the adapted standardized container right after it to be practicable for workers to walk. These spaces between containers are used for the arrangement of several auxiliary components of the living quarters, such as piping, wiring, etc. Provided that they are practicable for workers to walk, access for the workers to fix potential break-downs or failures.

Another characteristic of this invention is aimed for the construction of living quarters facilities within floating artefacts, to be constructed by applying the aforementioned method. Living quarters of this type involve:

a) A supporting structure with, at least, one vertical prismatic hole setup for allowing the unloading of standardized containers through it.
b) A variety of adapted standardized containers, fixated to the structure, in, at least, the vertical hole, in such a manner that several levels are built, and in the different levels each adapted standardized container is supported by supports which are fixated to the supporting structure, during the adapted standardized containers' installation process.

In a preferred embodiment of this invention, each adapted standardized container is supported by, at least, four point supports, which are fixated to the supporting structure columns, near to the intersection between beams and columns, in such a manner that the location of the supports mainly matches the locations of the adapted standardized containers' corners.

In another preferred embodiment of this invention, each adapted standardized container is fixated to the point supports on which it is supported, by using twist-lock devices.

In another preferred embodiment of this invention, each point support includes one reinforced edge protector for the fixation of one container's corner fixation, by using a double twist-lock device.

In compliance with another preferred embodiment of this invention, the subsequent supports are fixated approximately at one meter over the ceiling of the adapted standardized container right below.

One more characteristic of this invention is aimed for carrying out the aforementioned construction process of living quarters within adapted standardized container. One adapted standardized container of this kind, basically, has the following attributes:

a) It lacks one or both sideways walls, or part of one or both of them. This shall enable the creation of spaces at the living quarters with a surface which is bigger than that of one standardized container. For example, it is possible to arrange two standardized containers, without one sideways wall each, in such a manner that they are adjoining with one another, on the supporting structure, so that a room with a surface which doubles the surface of one standardized container is created. Another example is to arrange three containers, adjoining with one another, out of which two would be lacking one sideways wall, and the remaining one would be lacking both of them, on the supporting structure, so that a room with a surface which triplicates the surface of one standardized container is created. It is also possible to eliminate part of one sideways wall. This allows for rooms of different shapes and sizes to be arranged, by the appropriate combination of adapted standardized containers, with total or partial suppression of sideways walls.
b) It includes, at least, one vertical reinforcement pillar, between the lower longitudinal edge and the upper longitudinal edge in the sideways which are lacking, at least, part of the sideways wall, in order to limit the bending stress of the upper longitudinal edges. In fact, the inventors of this application have discovered that fully or partially retrieving a sideways wall does not have an impact on its structural resistance. Under these conditions, the weight of the upper reinforced edge protectors itself, when it comes to a side of the container lacking a sideways wall, causes for them to bend, by resulting in one deflection at its centre. In order to prevent this, the inventors of this application have included one or several vertical reinforcement pillars, depending on the surface of the suppressed sideways wall.

c) It includes one reinforcement alongside the lower longitudinal edges on the sides which are lacking sideways wall, in order to limit the deflection of the lower longitudinal edges. In fact, when a sideways wall is fully or partially eliminated, a similar impact to the one herein described in regard to the upper longitudinal edges, is caused. Deflection is generated at its central part. To solve this problem, the vertical pillars herein described cannot be applied. An additional reinforcement, which prevents the deflection from that longitudinal edge, needs to be added instead.

In compliance with a preferred embodiment of the invention, this reinforcement includes an additional flat steel platen, welded to the beam which forms the longitudinal edge, so that its U profile is closed. The U profile closure considerably increases the stiffness of the beam which forms the longitudinal edge, and so deflection of the lower longitudinal edge is prevented.

These modifications are added to the aforementioned herein, such as the suppression of part of the ceiling or flooring, in order to allow the inclusion of stairs, door and/or windows installation, piping or electricity wiring, based on the applicable needs, installation of certain furniture items, such as sinks, toilets, or any other component which is fixated for permanent term, etc. All these modifications are executed in such a manner that the external dimensions of the standardized container are not altered, and neither is its structural resistance. This allows for the standardized containers to be transported from the onshore factory, where the adaptation works are executed, to the floating artefact in which they shall be installed, by using any standard transport mean.

BRIEF DESCRIPTION OF THE FIGURES

FIG. 4 shows the corresponding perspective views of a container, which has been adapted, in compliance with this invention.

FIGS. 5*a*-5*b* respectively show a perspective view of the profile, which corresponds to the adapted standardized container shown in FIG. 4, and a perspective view in detail of the cross section of the same container, in which the reinforcement flat steel platen which is arranged in the lower longitudinal edge, corresponding to the side in which the sideways wall has been suppressed.

PREFERRED EMBODIMENT OF THE INVENTION

A preferred embodiment of the invention is described in more detail hereunder, referring to the hereby attached figures.

Figure 1A:
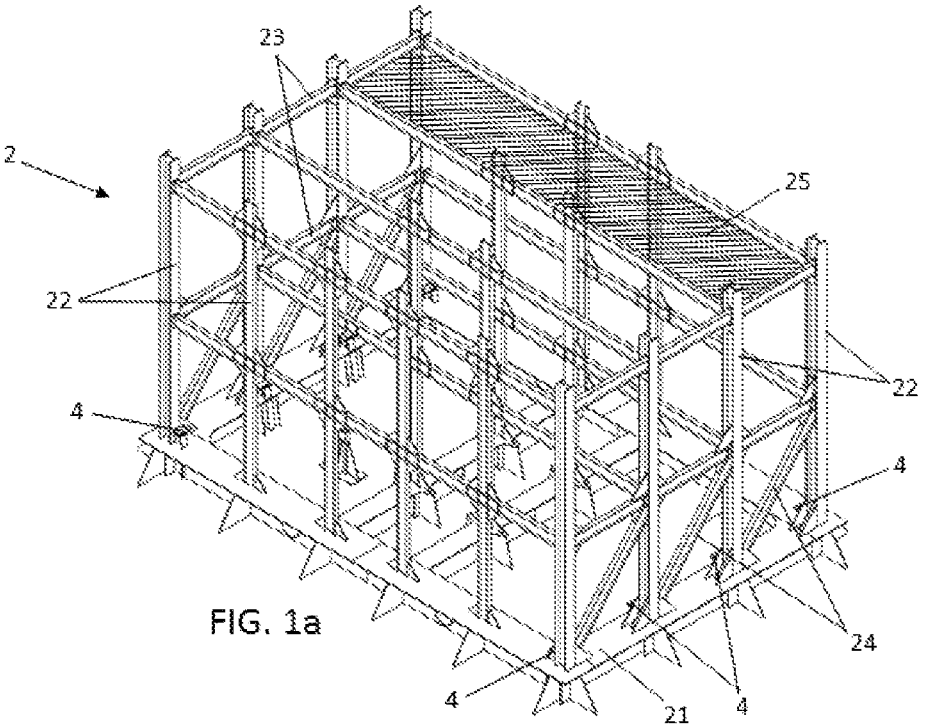
FIG. 1*a* shows a perspective view of the first stage of the invention procedure, in which the supporting structure with the point support, which correspond to the lowest level, may be observed.

FIG. 1*a* shows a perspective view of one supporting structure (2), in compliance with a preferred embodiment of the invention. As it may be observed, the supporting structure (2) is made of one base frame (21), composed of a horizontal beams' ensemble, which are perpendicularly arranged among them, and which are solidly fixated to the floating artefact surface. This base frame (21) forms a base for vertical columns (22) which are joint with cross beams (23) among them. The supporting structure (2) is also provided with some diagonal reinforcements (24), as necessary, based on the loads that it shall have to bear.

Figure 1B:
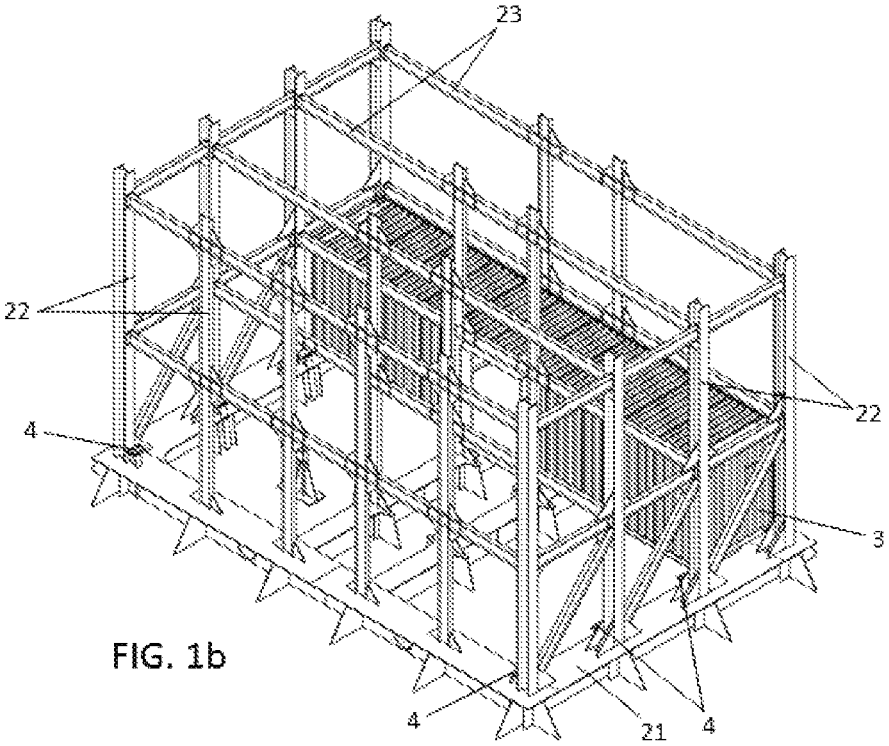
FIG. 1*b* shows a perspective view of an ulterior stage of the invention procedure, in which an adapted standardized container has been placed on the point supports of the lowest level.

The supporting structure (2) is designed in such a manner that it has vertical prismatic holes (25) of rectangular shape, for which the dimensions are slightly bigger than those of one standardized container (3). As it may be seen on FIG. 1, the holes (25) are rectangularly shaped and they are limited by a columns' (22) ensemble, made of appropriately arranged columns. This allows to unload the standardized containers (3), which are adapted in the manner previously herein described, by using a crane from the upper part of the supporting structure (2), until they are supported by the point supports (4) of the lowest level. These point supports (4) of the lowest level are fixated to the base of the columns (22) and they are also supported by the base frame (21). The locations of these support points (4) of the lowest level match the location of the corners of the standardized containers. This location is shown in FIG. 1*b* in which a standardized container (3) has already been installed at its location in the lowest level of the supporting structure (2). Once supported, the fixation of the container (3) to the aforementioned point supports (4) may be started, by using a fixation system based on twist-lock devices (8).

Figure 2A:
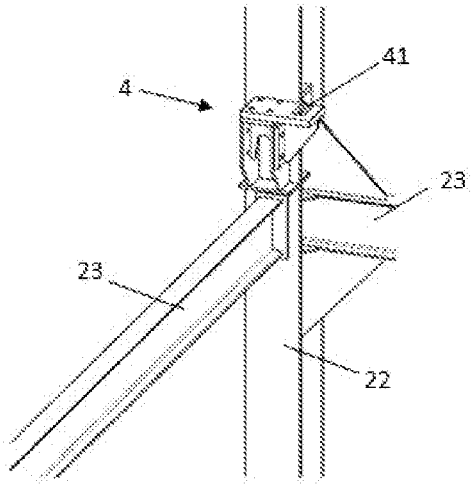
FIG. 2*a*-2*b* show the corresponding perspective views of a point support, in compliance with this invention.
Figure 2B:
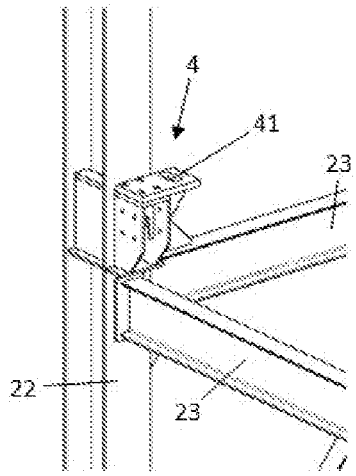

In fact, as it has been previously described herein, the fixation of the container (3) to the point supports (4) may be performed in several manners, even though in this embodiment in particular the fixation is executed by using twist-lock devices. FIGS. 2*a* and 2*b* show two perspective views of an example for point support (4), like those used for this invention. It is a structure made of flat steel platens, solidly fixated to one column (22) of the supporting structure (2), with the aim of providing support for one corresponding standardized container (3). As it may be observed, the point support (4) shows a mainly rectangular reinforced edge protector (41), setup for the insertion of a twist-lock device (8). Due to the fact that the standardized container (3) also shows a reinforced edge protector at its corners, a twist-lock device with double male components in order to perform the fixation. In this manner, the junction between each standardized container (3) and the four corresponding point supports (4) may be performed in an extremely fast manner, which barely takes some seconds. When compared, this is totally the opposite to what happens in the modular construction procedures which were known until now, in which the junction usually occupies all the edges of each container (3) and, moreover, it is performed through welding.

Figure 3A:
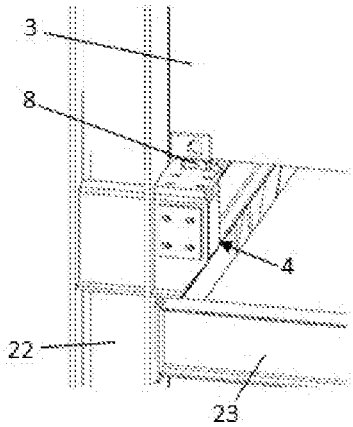
FIGS. 3*a*-3*b* show the corresponding perspective views of a container, which has been fixated to a point support, in compliance with this invention.
Figure 3B:
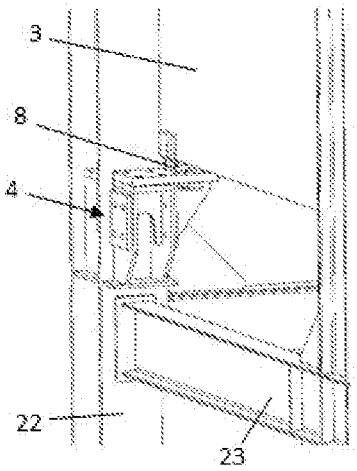

FIGS. 3*a*-3*b* show the corner of one container (3), which is already fixated to a point support (4), corresponding to a double twist-lock device (8). As it has been previously described, a double twist-lock device (8) essentially consists of a component provided with two rectangular protruding projections, arranged in opposite extremes of the component and which may rotate around the same rotation axis, with a small lever manual actuation. For fixating the corner of one container (3) to a point support, it suffices with placing the double twist-lock device (8) on the point support (4) first, in such a manner that one of the rectangular protruding projections is inserted inside the reinforced edge protector (41) of that support (4). Afterwards, the container (3) is unloaded, until it leans on the point support (4), so that the other protruding projection of the twist-lock device (8) is inserted within the reinforced edge protector at the aforementioned container's (3) corner. Last, it suffices with activating the lever in order for both rectangular protruding projections to rotate 90°, when compared to the initial position, so that the container's (3) corner is solidly fixated to the support (4), as shown on FIGS. 3*a* and 3*b*.

Figure 1C:
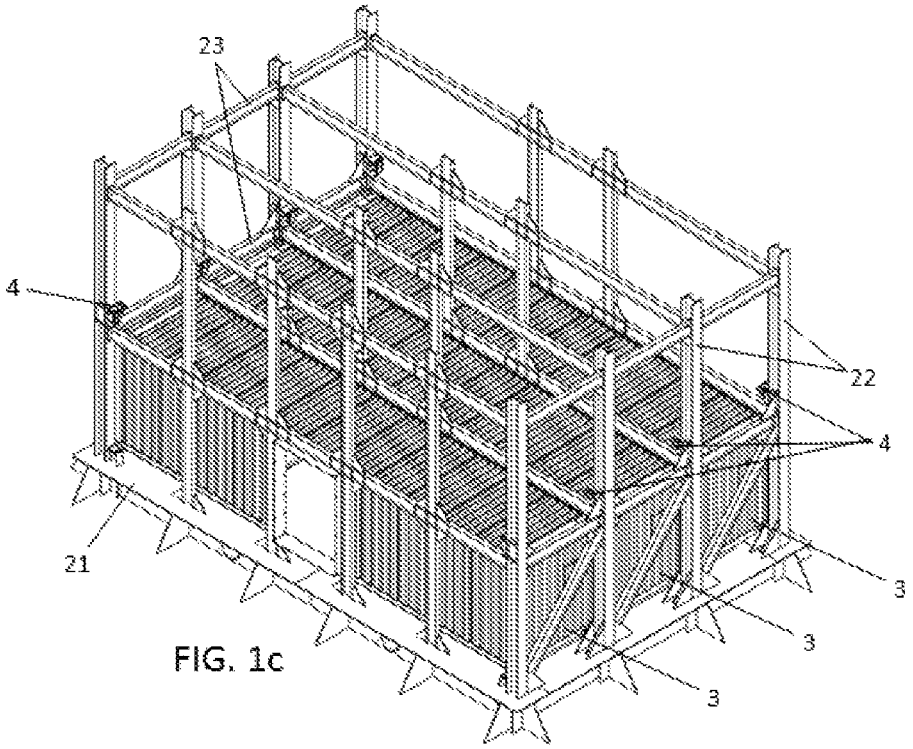
FIG. 1*c* shows a perspective view of an ulterior stage of the invention procedure, in which the adapted standardized containers' arrangement for the lowest level has been completed and the point supports of the second level have been fixated to the supporting structure.

Once the first container (3) of the lowest level is placed, the next container of the lowest level (3) is unloaded, and so forth, until the containers (3) of the lowest level are all placed and fixated, in compliance with FIG. 1*c*. In this figure, it may also be observed how the container (3) in the forefront has been modified for including an entry door. If it is aimed for one room to be created of three-times the size of one container (3), the central container is alleged to have no sideways walls. The modification process of the containers (3) shall be further described in detail herein.

Figure 1D:
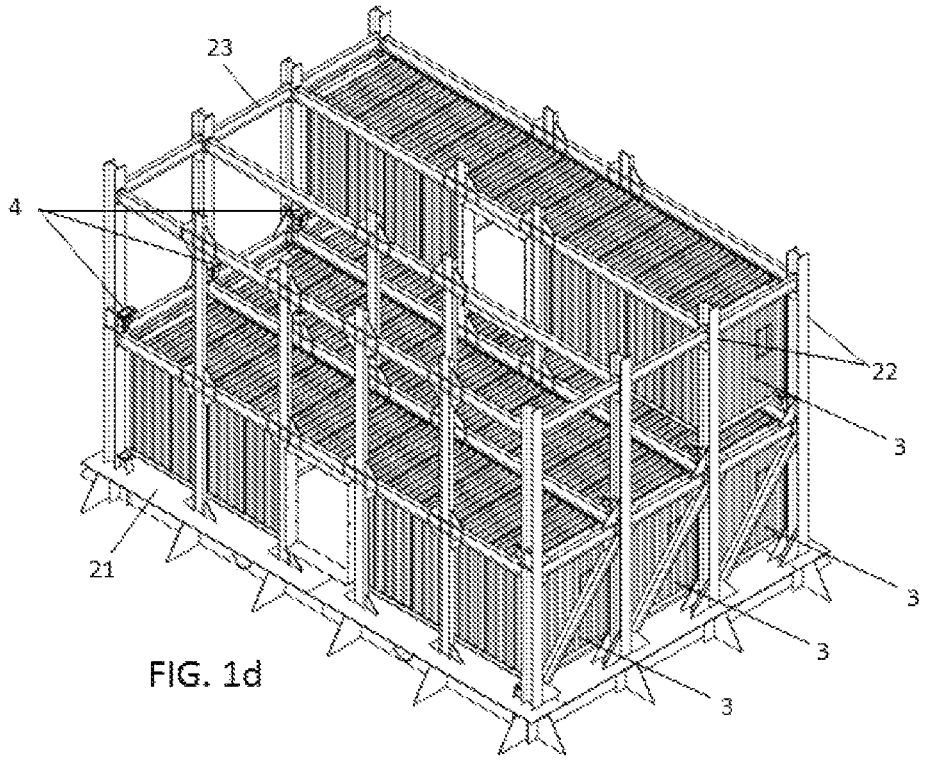
FIG. 1*d* shows a perspective view of an ulterior stage of the invention procedure, in which an adapted standardized container, which corresponds to the second level, has been placed on the point supports of the second level.
Figure 1E:
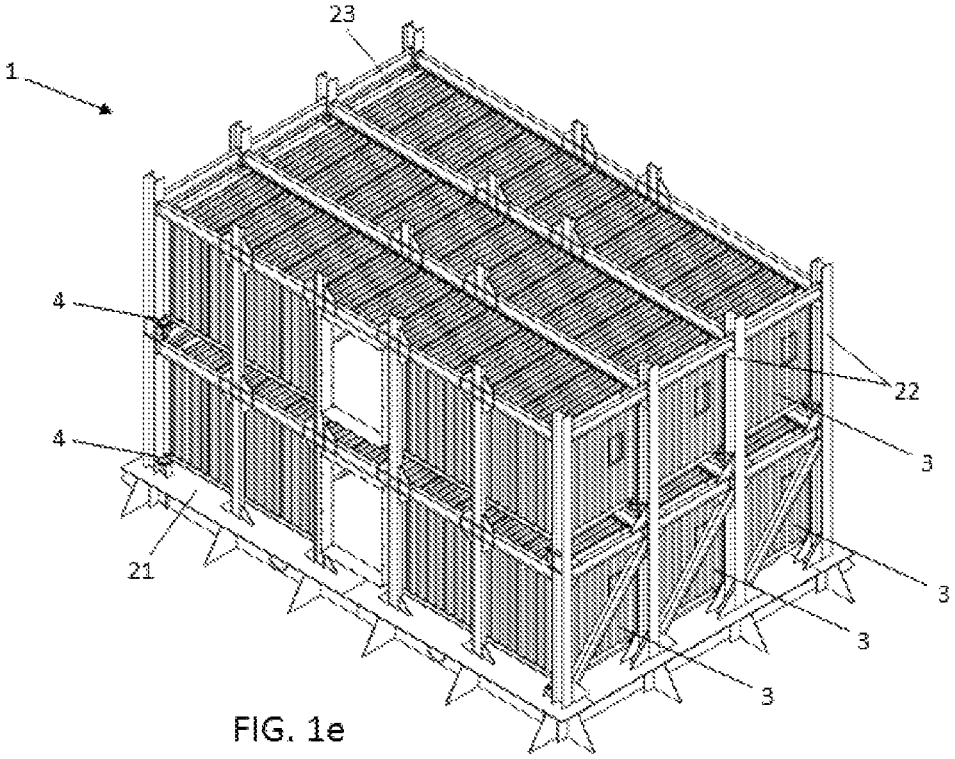
FIG. 1*e* shows a perspective view of an ulterior stage of the invention procedure, in which all the adapted standardized containers, which correspond to the second level, have already been placed on the point supports of the second level.

In FIG. 1*c* the point supports (4) of the subsequent level, which have been fixated to the corresponding columns (22) of the structure, once the container (3) right below has been placed, have also been shown. Therefore, the structure (2) is ready for the inclusion of a subsequent containers' (3) level. FIG. 1*d* shows a subsequent container (3), already fixated to the corresponding point supports (4), and FIG. 1*e* shows a perspective view of the already finished installation (1), in which the whole upper level of the containers (3), which already fixated to the corresponding point supports (4). As it may be observed, point supports (4) of the upper level are arranged at a certain height over the ceiling of the support container (3) right below them. In this manner, a space between each level of containers (3) is generated, which may have a height of approximately one meter for the layout of several auxiliary installations, such as ducts or electricity wiring. Apart from that, those spaces have dimensions big enough for it to be practicable to walk, what facilitates the execution or maintenance or repair tasks.

FIG. 4 shows one example of a standardized container (3) which is already adapted for its use at the living quarters facility (1) as the one described. This container (3) has been modified in such a manner that it preserves both the dimensions and structural resistance of a standardized container (3) without modifications. This allows for its certification to be kept, which enables for it to be handled in a standard manner, both during its transport and installation. On the contrary, other modified containers (3), which are known until now, lose their certification, so they can no longer be handled as standard containers (3) and, therefore, they lose a great part of the advantages they offer.

The adapted standardized container (3) on FIG. 4 fully lacks one of the sideways walls (31), what allows to combine it with one or more containers (3) to create bigger spaces. In order to preserve the structural resistance of the adapted standardized container (3), despite its sideways wall (31) suppression, which, as it had already been indicated, has supporting capacity, this adapted standardized container (3) includes a pair of vertical reinforcement pillars (32) and an additional flat steel platen (35) for reinforcement.

The vertical reinforcement pillars (32) are located at the central sideways area of the container (3), which lacks sideways wall (31) between the corresponding upper edge (34), and the lower edge (32). The fixation of those pillars (32) to the corresponding edges (34, 35) may be executed, for example, with welding. The layout of these reinforcement pillars (32) provides the container (3) with a similar structural resistance than the one provided by the original sideways wall (31) which has been suppressed.

The additional reinforcement flat steel platen (35) is shown on FIGS. 5*a* and 5*b*. FIG. 5*a* shows a side view of the container on FIG. 4, and FIG. 5*b* shows in detail the lower longitudinal edge (33). This edge (33) has section in U, open towards the left side. In order to reinforce it, the additional flat steel platen (35) is welded at a location which closes the wings section in U, what provides the lower longitudinal edge (33) with more stiffness.

The combination of the vertical reinforcement pillars (32) and the additional reinforcement flat steel platen allows to prevent deflection at the lower (33) and upper (35) longitudinal edges of the adapted container (3).

The invention claimed is:

1. Construction procedure of living quarter for floating artefacts, which involves the following steps:

building a supporting structure (2) over the floating artefact, aimed for supporting several levels of standardized containers (3); and fixing several adapted standardized containers (3) to the supporting structure (2), so that they form a living quarters facility (1) of several levels, characterized by the manner to arrange the standardized containers (3), which involves the following steps:

unloading a first adapted standardized container (3) through, at least, one vertical prismatic hole (25) of the supporting structure (2) until it is leaned on point supports (4) of the lowest level;

fixing the first adapted standardized container (3) to the aforementioned supports (4) of the lowest level;

for each subsequent level, fixate some point supports (4) over the already adapted standardized container (3) to the supporting structure (2), unload a subsequent adapted standardized container (3) until it leans on the aforementioned supports (4) and fixate the aforementioned subsequent adapted standardized container to the subsequent aforementioned supports on which it leans.

2. Procedure in compliance with claim 1, which involves for each adapted standardized container (3) to be supported, at least, by four point supports (4) which are fixated to columns of the supporting structure (2), near intersections between beams and the columns, in which the supports position essentially matches the location of the adapted standardized containers' (3) corners.

3. Procedure in compliance with claim 2, in which the fixation of each adapted standardized container (3) to the point supports (4) on which it leans is executed by using twist-lock devices (8).

4. Procedure in compliance with claim 3, in which the fixation by using twist-lock devices involves, for each corner of the adapted standardized containers (3), inserting one double twist-lock device (8) in a reinforced edge protector of the point support (4) and in a reinforced edge protector of the adapted standardized container's (3) corner.

5. Procedure in compliance with claim 4, in which the subsequent supports (4) are fixated at approximately one meter over the ceiling of the adapted standardized container (3) right below.

6. Living quarters facility (1) for floating artefacts, built by the construction procedure within any of the aforementioned claims, which includes:

one supporting structure (2) which includes, at least, one vertical prismatic hole, arranged for allowing the unloading of standardized containers (3) through it; and a variety of adapted standardized containers (3), fixated to the supporting structure (2), at least, a vertical hole, in such a manner that several levels are created, in which each adapted standardized container (3) over certain supports (4) fixated to the supporting structure (2) during the procedure of adapted standardized containers installation (3).

7. Living quarters facility (1), in compliance with claim 6, in which each adapted standardized container (3) is supported by, at least, four point supports (4), fixated to the supporting structure columns (2), near to intersections between beams and the columns, and in which the supports (4) location essentially matches the adapted standardized containers' (3) corners.

8. Living quarters facility (1), in compliance with claim 7, in which each adapted standardized container (3) is fixated to the point supports by which it is supported, through twist-lock devices (8).

9. Living quarters facility (1), in compliance with claim 8, in which each point support (4) includes one reinforced edge protector for the fixation of a container's (3) corner through a double twist-lock device (8).

10. Living quarters facility (1), in compliance with claim 7, in which the subsequent supports (4) are fixated approximately at one meter over the adapted standardized container (3) right below.

11. Standardized container (3), adapted for executing the construction procedure of the living quarters facilities, in compliance with claim 1, which is characterized by:

It lacks one or both sideways walls (31) or part of one or both of the sideways walls (31) in order to enable the creation of spaces with a bigger surface than the one of a standardized container (3);

It includes, at least, one vertical reinforcement pillar (32) between the lower longitudinal edge (33) and the upper longitudinal edge (34) in the sides which are lacking, at least, part of the sideways wall (31), in order to limit the deflection of the upper longitudinal edges (34);

It includes, at least, one reinforcement (35) alongside the lower longitudinal edges (33) in the sides which are lacking at least part of the sideways wall (31) to limit the deflection of the lower longitudinal edges (33).

12. Standardized container (3), in compliance with claim 11, in which the reinforcement (35) alongside the lower longitudinal edges (33), in sides which are lacking sideways walls, includes an additional flat steel platen (35), welded to that lower longitudinal edge (33) in such a manner that its U profile is closed.

* * * * *